United States Patent [19]

Schultz et al.

[11] Patent Number: 4,818,332

[45] Date of Patent: Apr. 4, 1989

[54] BUSINESS FORM SEALER/CONVEYOR

[75] Inventors: Elmer J. Schultz, Sanborn; David G. Wagner, Amherst, both of N.Y.

[73] Assignee: Moore Business Forms, Inc., Grand Island, N.Y.

[21] Appl. No.: 861,629

[22] Filed: May 7, 1986

Related U.S. Application Data

[63] Continuation of Ser. No. 537,268, Sep. 29, 1983, abandoned.

[51] Int. Cl.[4] ..... B31B 31/00

[52] U.S. Cl. ..... 156/499; 156/556; 156/558; 270/53; 271/149; 271/245

[58] Field of Search ..... 156/558, 499, 311–313, 156/563, 556; 270/53, 58; 271/146, 245

[56] References Cited

U.S. PATENT DOCUMENTS

| | | | |
|---|---|---|---|
| 2,324,834 | 7/1943 | Gurwick | 282/DIG. 2 |
| 2,557,723 | 6/1951 | Brenn . | |
| 2,990,173 | 6/1961 | Melville . | |
| 3,053,310 | 9/1962 | Spooner . | |
| 3,596,899 | 8/1971 | Fulk . | |
| 3,625,803 | 12/1971 | Masulis | 156/563 |
| 3,671,363 | 6/1972 | Bruder | 156/556 |
| 4,012,276 | 3/1977 | Schertler | 156/563 X |
| 4,177,101 | 12/1979 | Evans | 156/563 X |
| 4,288,274 | 9/1981 | Holz | 156/563 X |
| 4,295,642 | 10/1981 | Kelly | 270/53 |
| 4,344,610 | 8/1982 | Jeschke et al. . | |
| 4,388,144 | 6/1983 | Weinhoner | 156/538 |
| 4,398,986 | 8/1983 | Smith et al. | 156/558 X |
| 4,420,147 | 12/1983 | Knox et al. | 270/37 |
| 4,526,642 | 7/1985 | Caughey | 412/902 X |

*Primary Examiner*—David Simmons
*Attorney, Agent, or Firm*—Allegretti & Witcoff

[57] ABSTRACT

A sealer/conveyor aligns and conveys groups of form sheets, and seals them into form sets.

5 Claims, 4 Drawing Sheets

BUSINESS FORM SEALER/CONVEYOR

This application is a continuation of application Ser. No. 537,268, filed on Sept. 29, 1983 abandoned.

BACKGROUND OF THE INVENTION

This invention relates to business forms handling equipment suitable for business offices, and more particularly, to an apparatus for conveying and sealing collated form sheets into form sets.

Continuous business form assemblies have long been considered desirable for mass mailings and the like. High speed printers have been used for both custom and non-variable printing of such assemblies. However, certain desirable high speed printers print with toners which are set or fixed by heat. Such printers are incompatible with form assembly constructions having heat sealable adhesives. The assembly webs having the heat sealable adhesives cannot be fed through the printers or other heat generating equipment because otherwise the webs would prematurely, undesirably adhere to the equipment mechanisms. As a result, the webs of such assemblies having adhesive must be assembled or collated with the printed webs after printing.

Yet with this sequence of assembly, sheet length differentials occur between the sheets of the adhesive coated webs, and the printed webs. The heating of the printed webs during the setting of toners dries the sheets of the printed webs, compounding a sheet length mismatch. Further, standard sealing equipment cannot accommodate a two ply collated form.

SUMMARY OF THE INVENTION

An object of the inventors which led to the making of this invention was to provide business form sealing equipment capable of consistently, continuously collating and sealing form sheets of matched and mismatched form sheet lengths.

Another object was to provide such equipment of a compactness, reliability, and ease of use suitable for typical business offices and personnel.

The invention provides such sealing equipment, and proceeds, in part, with a reversal of sealing and detaching functions of standard sealing equipment. Form sheets are collated first, which allows sheet length differences to be accommodated, then detached from their webs, and then sealed. The invention also incorporates the conveying of the sets of sheets being sealed in an overlapped or shingled manner.

In a principal aspect, then, the present invention is an apparatus for conveying and sealing collated form sheets into form sets, at least one of the form sheets for each set having heat sealable adhesive. The apparatus comprises a base, heating means and conveying means on the base. The heating means constitutes means for heating the heat sealable adhesive to seal form sheets of the group together. The conveyor means constitutes means for conveying the groups of form sheets through the heating means. The conveyor means includes means for aligning the form sheets of the groups before the groups enter the heating means.

BRIEF DESCRIPTION OF THE DRAWING

The preferred embodiment of the invention will be described in relation to the accompanying drawing, which consists of four views, or figures. The figures are as follows.

DETAILED DESCRIPTION OF THE PREFERRED EMBODIMENT

The preferred embodiment of the present invention is considered to be illustrative, and not restrictive, of the present invention. All modifications which come within the scope of the appended claims are intended to be embraced within the claims.

Figure 1:
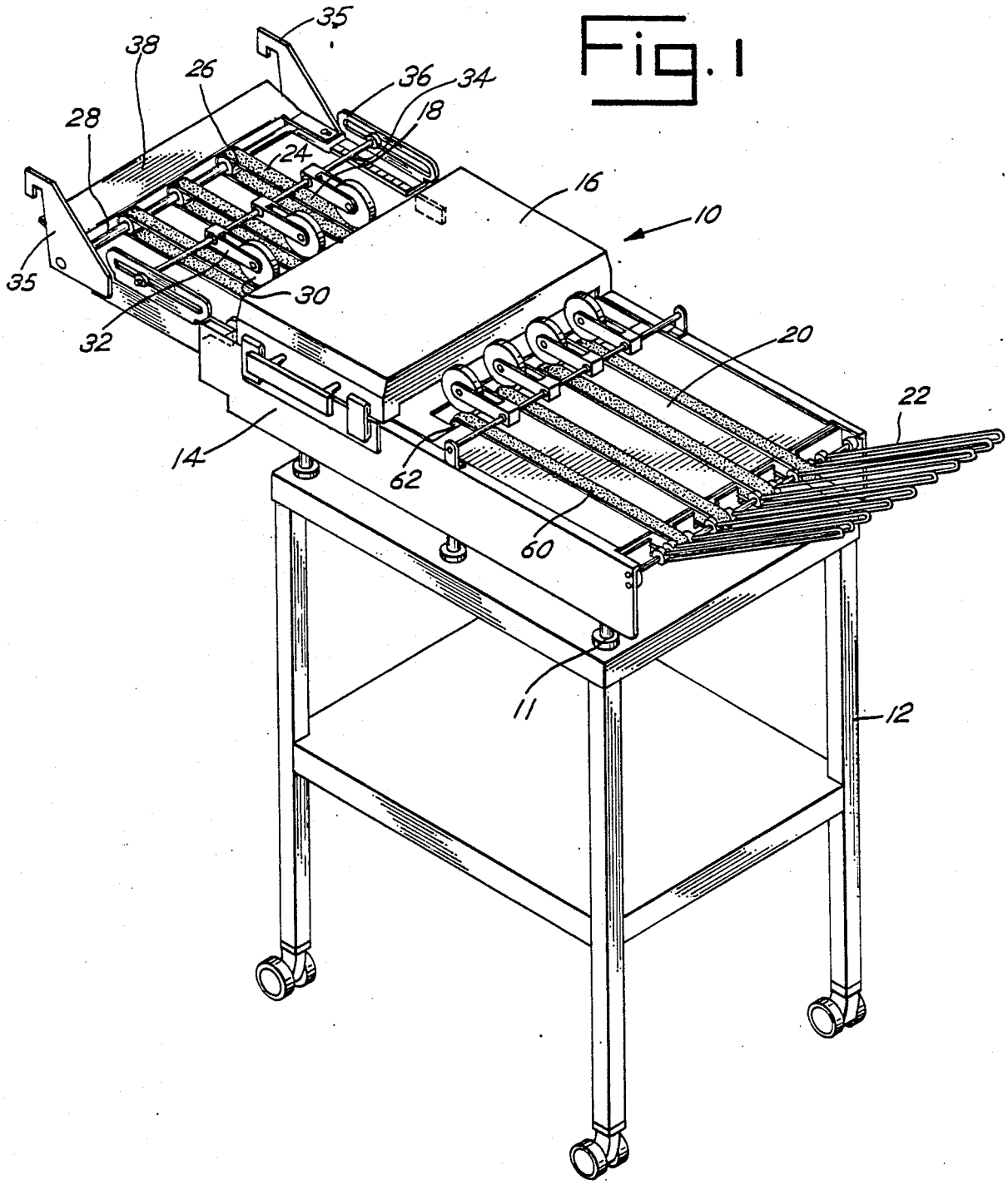
FIG. 1 is a perspective view of the preferred embodiment with the infeed portion to the upper left.

Referring to FIG. 1, the preferred embodiment of the present invention is a sealer/conveyor 10 adapted to operate on 110 Volt current and rest atop feet such as foot 11 on a mobile stand 12, for general office use. The sealer/conveyor 10 includes a base or frame 14, heating structure 16, infeed conveyor structure 18, output conveyor structure 20, and stacking rack 22. Form sheets are fed in groups on the infeed conveyor 18 through the heating structure 16, where they are sealed into form sets, then fed onto the outfeed conveyor 20, and stacked against the rack 22.

As shown only in FIG. 1, the infeed conveyor structure 18 includes an infeed conveyor of a plurality of conveyor belts such as belt 24 stretched about pulleys such as pulley 26 on pulley shafts such as shaft 28.

Also as shown only in FIG. 1, a plurality of alignment or nip rollers 30 are mounted to the base 14, above the conveyor structure 18. The rollers 30 are adapted to be friction driven by the infeed conveyor belts. Pivotable links 32 provide for rotation of the rollers 30 about their central axes, the pivoting of the rollers 30 about a shaft 34. The shaft 34 slides within slotted support brackets 36, for adjustment of the distance of the rollers 30 to the outermost end 38 of the infeed conveyor structure.

The sealer/conveyor 10 is usable with a detacher, a collator, or similar machines, for receiving form sheets from such equipment on the conveyor belts of the infeed conveyor. The infeed conveyor belts are driven to provide a form speed substantially less than that of an associated detacher or the like. The sealer/conveyor is attached by frame hooks 35 to the associated equipment. Form sheets, whether matched or mismatched, are deposited on the infeed conveyor belts 24. Where mismatching is expected, the rollers 30 are adjusted to be sufficiently close to the infeed end 38 that the distance from the end rollers of the detacher or the like to the rollers 30 is less than one form length. As a result of the conveyor speed and position of the rollers 30, form sheets of a form set arriving mismatched at the rollers 30 are jogged or slid relative to each other into alignment.

In more detail, where a plurality of mismatched form sheets are driven onto the conveyor belts 24, the leading edge of the form sheet which is first to arrive at the rollers 30 will be slowed to the speed of the belts 24 and rollers 30, at the nip of the belts 24 and rollers 30. Remaining form sheets, the leading edges of which have not arrived at the rollers 30, continue to be driven at higher speed to the rollers 30. As the leading edge of each remaining form sheet arrives at the nip of the belts 24 and rollers 30, the leading portion of each form sheet is slowed, and each leading edge is substantially aligned or matched with the leading edge of the first arriving sheet.

The aligned form sheets continue to move, at the reduced speed of the belts 24 and rollers 30, into the heating structure 16. As form sheets of further form sets arrive at the rollers 30, these further form sheets overlap the trailing portions of the form sheets of preceding form sets. The sealer/conveyor 10 accommodates such overlapped or shingled form sets, which remain shingled until racked.

Figure 2:
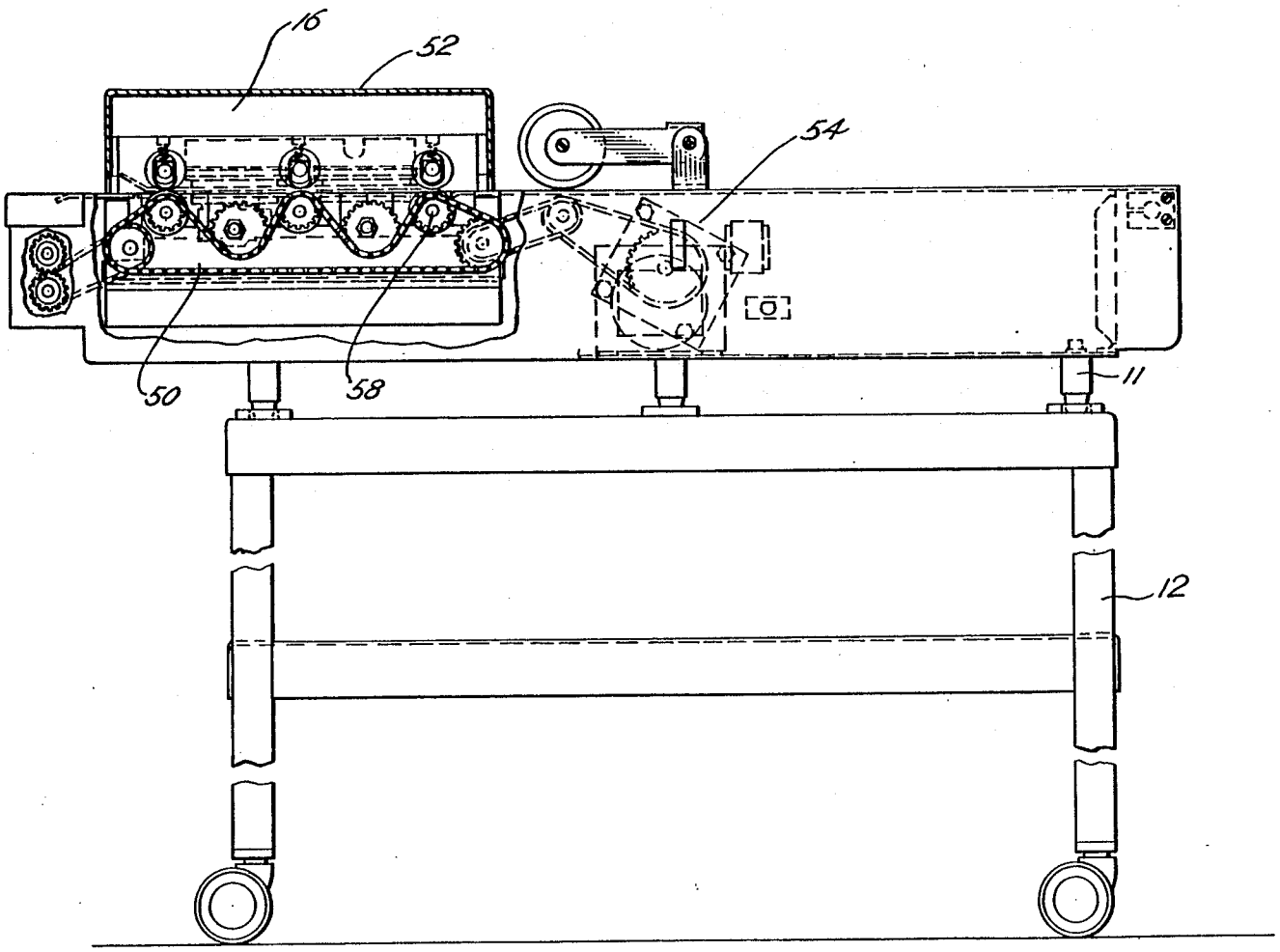
FIG. 2 is a side elevation view of the preferred embodiment, with the frame partially cut away to reveal internal detail.
Figure 3:
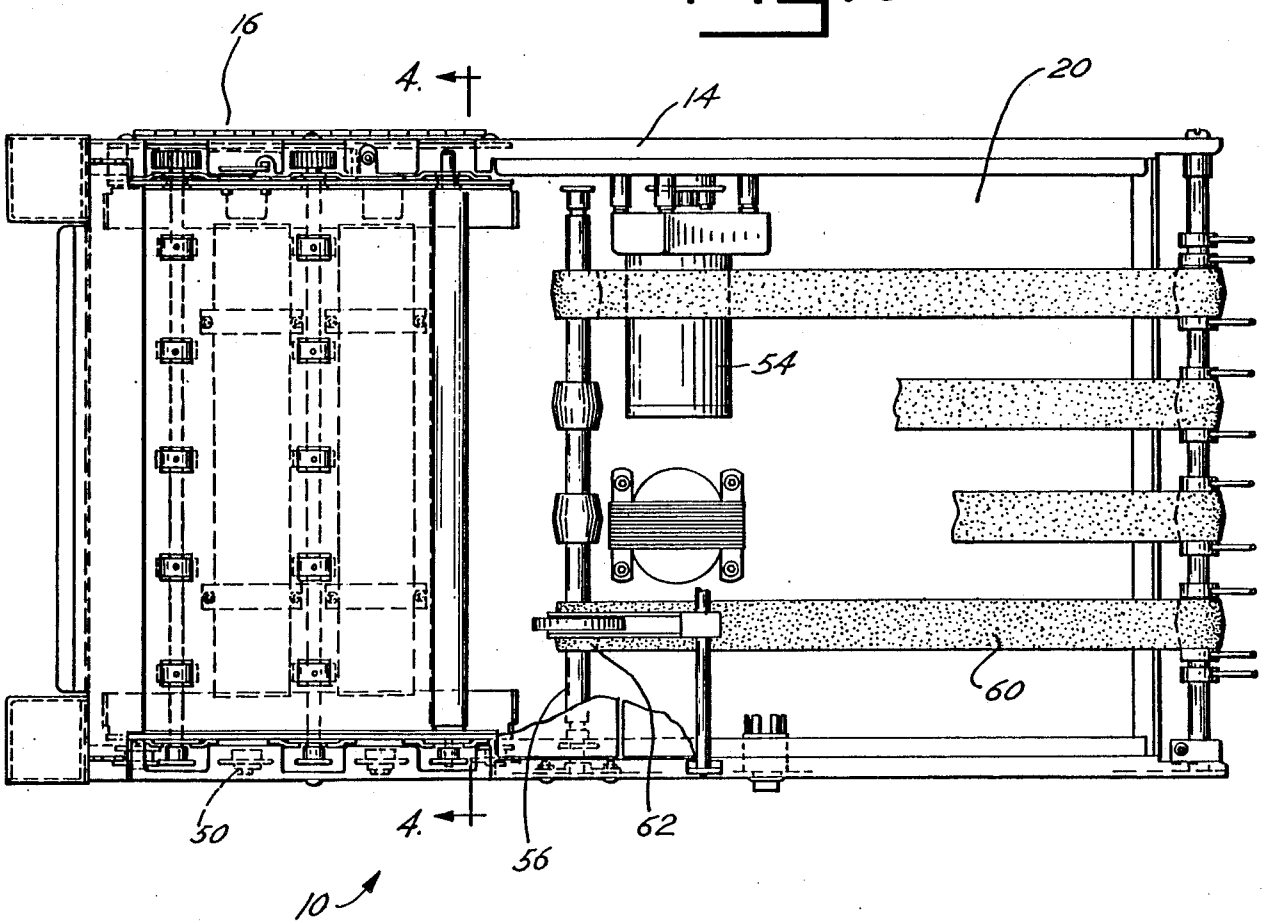
FIG. 3 is a top or plan view of the preferred embodiment, with the partial cover shown in FIGS. 1 and 2 removed to reveal internal detail.
Figure 4:
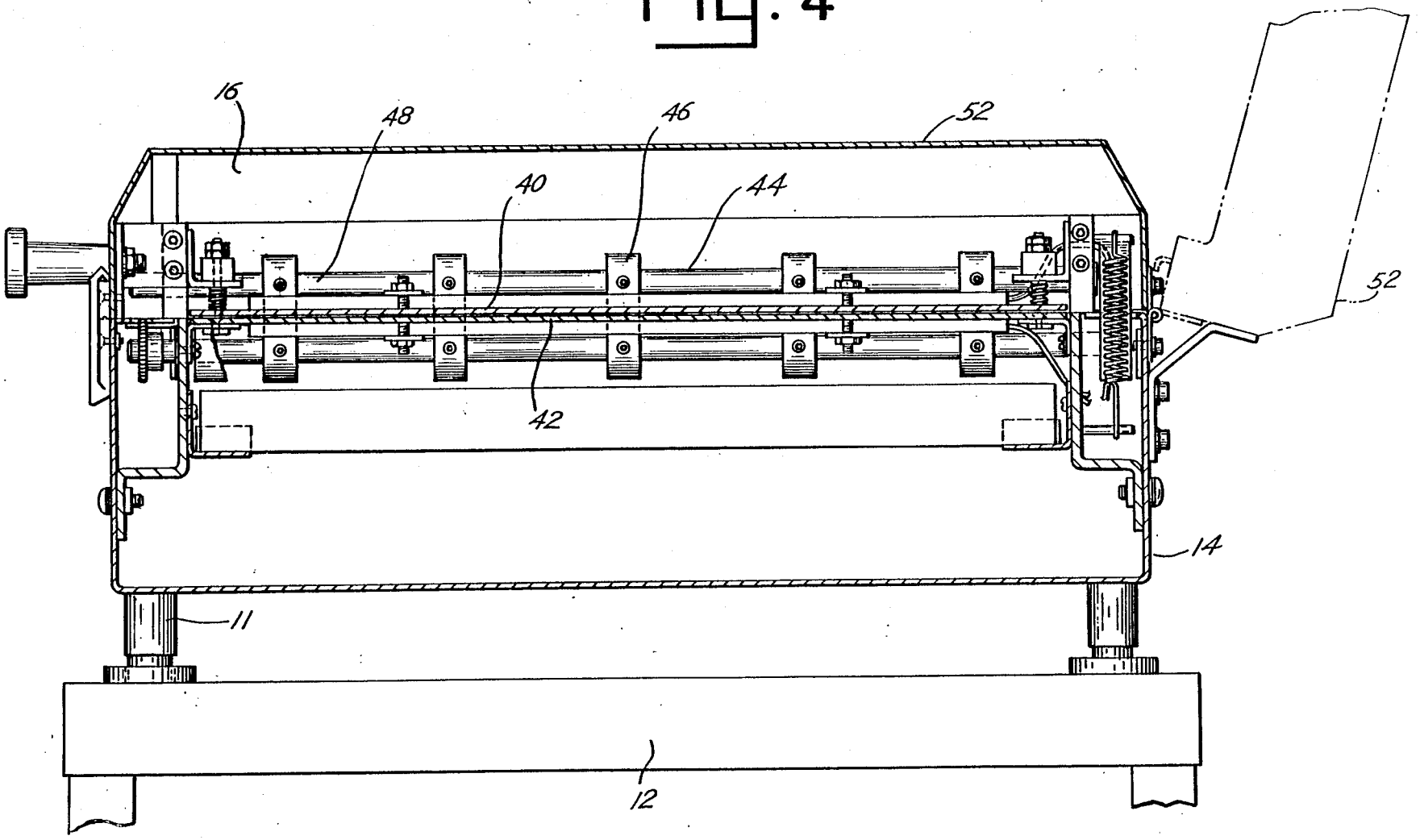
FIG. 4 is a cross-section view taken along line 4—4 of FIG. 3.

The overlapped form sets move at the speed established by the infeed conveyor structure 18 into the heater structure 16. As shown in FIGS. 2–4, the heater structure 16 includes vertically spaced upper and lower heating platens 40, 42. Platen or pressure rollers such as roller 44 include roller segments such as 46 on shafts such as 48. The roller segments extend through cut-outs in the platens, to drive the shingled form sets through the heating structure 16, between the platens 40, 42.

As shown in FIG. 2, the platen rollers include idler rollers in the cover 52 of the heating structure 16, and driving rollers driven by a chain drive 50 from a motor 54. The motor 54 drives a shaft 56 of the output conveyor structure 20, which drives sprockets such as sprocket 58 mounted along the shafts of the driving platen rollers. The shaft 56 and sprocket 58 are portions of the drive 50.

The platens 40, 42 heat by electrical resistance. The speed of each form set through the heating structure 16 is equal to the speed of the infeed conveyor 18, while the number of form sets through the heating structure per unit time is determined by the speed of the detacher of other associated equipment. As an example, each form may travel through the heating structure 16 at an infeed conveyor speed of thirty feet per minute, while the form sets may accumulate on the sealer/conveyor at a detacher speed of up to sixty feet per minute. The length and temperature of the platens 40, 42 are set to soften the heat-sealable adhesive of the form sets, as they pass between the platens 40, 42.

As most preferred, the platens 40, 42 soften adhesive on form sets traveling at the conveyor speed stated as an example, thirty feet per minute, and accumulating at the detacher speed stated as an example, up to sixty feet per minute. Also as most preferred, the platens 40, 42 soften adhesive on form sheets of weight from 18 pound bond to 99 pound index.

The resulting, sealed form sets exit the heating structure 16 onto an output conveyor of a plurality of output conveyor belts such as 60 stretched about pulleys such as 62, as shown in FIG. 1. The ouput conveyor belts are driven at the same speed as the input conveyor belts. At the terminal end of the output conveyor structure 20, the form sets are driven onto the rack 22. Since the form sets remain shingled on the output conveyor belts, each form set acts as a guide for movement of following form sets onto the rack 22. The form sets remain stacked upon the rack 22, in condition for use, until manually removed.

The invention, and the manner and process of making and using it, are now described in such full, clear, concise and exact terms as to enable any person skilled in the art to which it pertains, to make and use the same. The best mode contemplated by the inventor of carrying out the invention is set forth. It is to be understood, of course, that the foregoing describes a preferred embodiment of the present invention and that modifications may be made therein without departing from the spirit or scope of the present invention as set forth in the appended claims. To particularly point out and distinctly claim the subject matter regarded as invention, the following claims conclude this specification.

What is claimed and regarded as invention is:

1. Apparatus for conveying and sealing groups of form sheets into form sets, at least one of the form sheets for each form set having heat sealable adhesive, the apparatus comprising;

a base;

heating means on the base for heating the heat sealable adhesive to seal the form sheets of the groups together; and conveyor means on the base conveyor the groups of form sheets through the heating means, the conveying means including means for receiving groups of form sheets moving at a first speed and overlapping of the groups of form sheets into overlapped groups for conveying the overlapped groups at a second speed through the heating means, the second speed being less than the first speed.

2. Apparatus as in claim 1 in which the conveyor means includes an infeed conveyor, pressure rollers, an output conveyor, and alignment rollers, and in which the heating means includes heating platens, the heating platens being between the infeed conveyor and the output conveyor, and the pressure rollers being among the heating platens.

3. Apparatus as in claim 2 in which the infeed conveyors, pressure rollers and output conveyor are drivably adapted to provide constant speed movement of the groups of form sheets and resultant form sets.

4. Apparatus as in claim 1 in which the conveyor means includes means for aligning the form sheets of the groups before the groups enter the heating means.

5. Apparatus as in claim 4 wherein the form sheets include leading edges and the aligning means includes means for aligning the leading edges of the form sheets of the groups in superimposed relationship before the groups enter the heating means.

* * * * *